US008074362B2

(12) United States Patent
Gui et al.

(10) Patent No.: US 8,074,362 B2
(45) Date of Patent: Dec. 13, 2011

(54) MULTI-BLADE UTILITY KNIFE

(75) Inventors: Yao Kun Gui, Shanghai (CN); Zheng Guo Wang, Shanghai (CN)

(73) Assignee: Meridian International Co., Ltd. (CN)

( * ) Notice: Subject to any disclaimer, the term of this patent is extended or adjusted under 35 U.S.C. 154(b) by 263 days.

(21) Appl. No.: 12/390,870

(22) Filed: Feb. 23, 2009

(65) Prior Publication Data

US 2009/0300920 A1 Dec. 10, 2009

(30) Foreign Application Priority Data

Jun. 6, 2008 (CN) ..... 2008 2 0048894 U

(51) Int. Cl.
*B26B 1/04* (2006.01)

(52) U.S. Cl. ..... 30/156; 30/155; 30/161; 30/330; 30/339

(58) Field of Classification Search ..... 30/152, 30/155, 156, 157, 161, 162, 337, 339, 330
See application file for complete search history.

(56) References Cited

U.S. PATENT DOCUMENTS

| | | | | |
|---|---|---|---|---|
| 2,464,206 | A * | 3/1949 | Becker | 30/304 |
| 4,442,600 | A | 4/1984 | Felix-Dalichow | |
| 4,509,651 | A * | 4/1985 | Prindle | 211/70.6 |
| 4,578,865 | A * | 4/1986 | Keller | 30/304 |
| 4,811,486 | A | 3/1989 | Cunningham | |
| 5,511,261 | A * | 4/1996 | Collins | 7/158 |
| 5,584,123 | A * | 12/1996 | Chi | 30/125 |
| 5,875,551 | A * | 3/1999 | Huang | 30/151 |
| 6,006,433 | A * | 12/1999 | Baltazar | 30/162 |
| 6,371,312 | B1 * | 4/2002 | Tsuchida | 211/70.7 |
| 6,467,173 | B1 * | 10/2002 | Umstead et al. | 30/144 |
| 6,574,872 | B2 | 6/2003 | Roberts et al. | |
| 6,722,044 | B2 * | 4/2004 | Timidaiski | 30/338 |
| 6,915,577 | B2 * | 7/2005 | Scala | 30/156 |
| 7,003,833 | B2 | 2/2006 | Feliciano | |
| 7,040,022 | B2 * | 5/2006 | Ping | 30/161 |
| 7,134,207 | B2 * | 11/2006 | Ping | 30/125 |
| 7,337,546 | B2 * | 3/2008 | Cheng | 30/156 |
| 7,480,997 | B2 * | 1/2009 | Ping | 30/161 |
| 2003/0037444 | A1 * | 2/2003 | Chunn | 30/337 |
| 2004/0103541 | A1 * | 6/2004 | Scarla | 30/161 |
| 2005/0204567 | A1 * | 9/2005 | Ping | 30/161 |
| 2007/0130777 | A1 | 6/2007 | Ping | |
| 2008/0086822 | A1 * | 4/2008 | Elsener | 7/118 |
| 2008/0086894 | A1 * | 4/2008 | Sullivan | 30/155 |
| 2009/0217536 | A1 * | 9/2009 | Medhurst | 30/337 |
| 2009/0223063 | A1 * | 9/2009 | Hallquist et al. | 30/162 |
| 2009/0300920 | A1 * | 12/2009 | Jiang | 30/152 |

* cited by examiner

*Primary Examiner* — Hwei C Payer
(74) *Attorney, Agent, or Firm* — Jason R. Sytsma; Shuttleworth & Ingersoll, PLC

(57) ABSTRACT

A foldable hand tool having a blade holder mounted with a handle for movement from folded and unfolded positions. The blade holder has an opening adapted to receive blades of different sizes. The foldable hand tool further has a locking mechanism to lock the holder in an open position. A blade holder lock engages a resilient arm formed in the side wall of the handle.

8 Claims, 4 Drawing Sheets

MULTI-BLADE UTILITY KNIFE

The present application claims priority under 35 USC §119 to Chinese application 200820048894.1 filed Jun. 6, 2008, which is incorporated herein by reference.

BACKGROUND

Cutting devices, such as utility knives, have been developed for use in various applications, such as, for example, construction, packaging and shipping, carpet installation, as well as other purposes. Those who use these tools as a knife may also require other tools, such as, for example saw blades, and knife blades of varying shapes and thickness. Some multi-purpose utility tools with several individual tools have a wide cumbersome handle with a cavity formed between two side walls so that all the tools fold in between the walls. Each tool then rotates outward and locks into place. The locking mechanism is typically formed of several moving parts including a spring.

SUMMARY OF THE INVENTION

A foldable hand tool having a blade holder mounted with a handle for movement from folded and unfolded positions. The blade holder has an opening adapted to receive blades of different sizes. The foldable hand tool further has a locking mechanism to lock the holder in an open position. A blade holder lock engages a resilient arm formed in the side wall of the handle.

DETAILED DESCRIPTION

Figure 1:
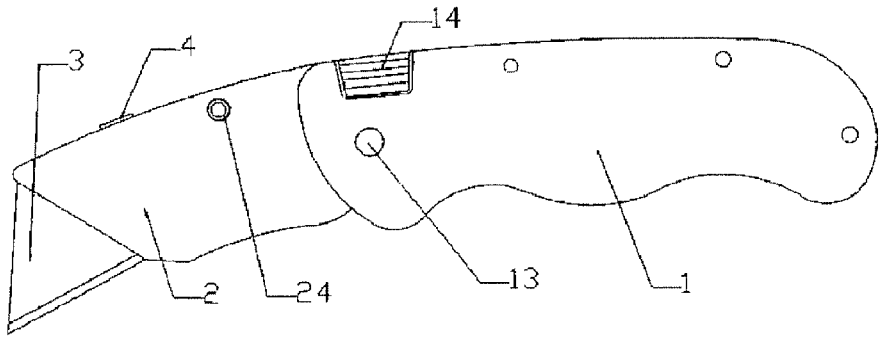
FIG. 1 is a front side view of the tool in the open position.
Figure 2:
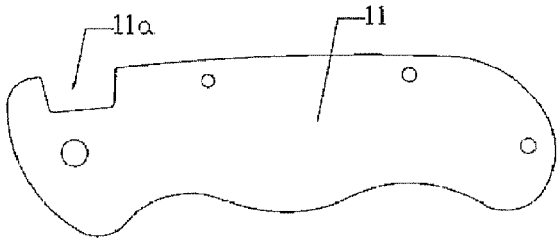
FIG. 2 is front side view of the tool handle.
Figure 3:
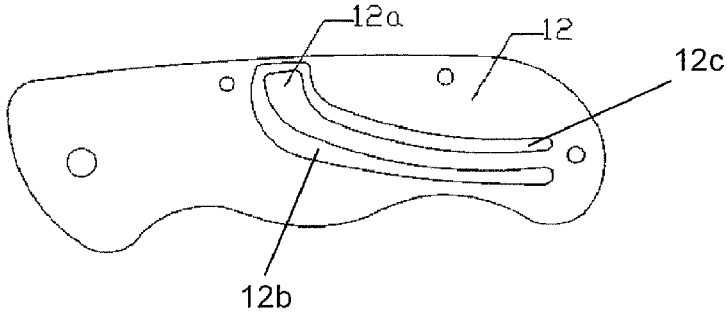
FIG. 3 is a back side view of the handle.

Referring to FIG. 1 there is shown an illustration of an embodiment of the tool in the open position. The blade holder

Figure 11:
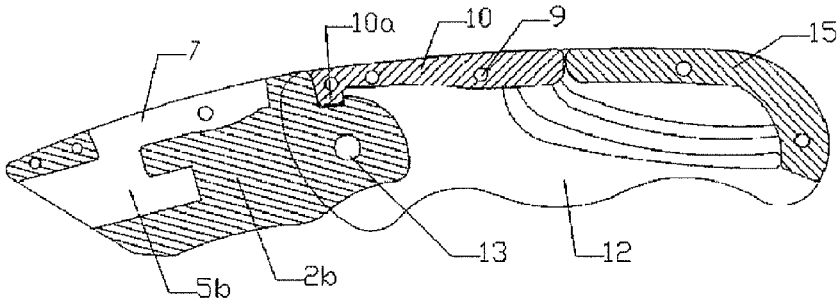
FIG. 11 is a cross-section view of the tool taken on the line 11-11 of FIG. 14*a* and showing the tool in the open position at the second blade slot.

2 extends outward from the handle 1 and is attached to the handle 1 at a pivot point by pin 13. In this arrangement the blade holder 2 pivots about the axis between the folded position and the unfolded or locked position. In the folded position tool handle 1 is long enough to allow a blade 3, shown as a knife blade 3, to be positioned between front side wall 11 and back side wall 12 to protect the user from the knife's sharp edge. Blade holder 2 has a pin 24, which serves to pivotally attach blade lock 4 to the blade holder 2 within a slot 7 of the handle 2 (see FIGS. 8, 9, 11). The blade lock 4 allows the user to remove and replace the blade 3. The pin 24 also aides the user with extending the blade holder 2 from its folded position.

Figure 5:
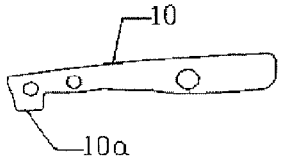
FIG. 5 is a plan view of the blade holder lock.
Figure 6:
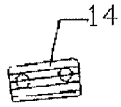
FIG. 6 is a plan view of the thumb grip on the blade lock.

When the user desires to close blade holder 2 and move the blade 3 to its folded position, the tool thumb pad 14, also shown in FIG. 6, provides a surface to push up on blade holder lock 10 to disengage the blade holder 2 and allow blade holder 2 to pivot down into the space created between front side wall 11 and back side wall 12. Thumb pad 14 is attached to blade holder lock 10, shown in FIG. 5. The thumb pad's top face 14 is positioned within cut-out 11*a* in front side wall 11 and sits flush with the top face of the tool handle 1.

Figure 4:
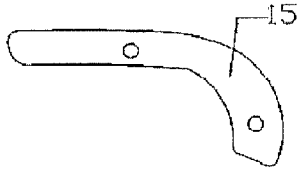
FIG. 4 is a plan view of the spacer between the front and back side walls.

Front side wall 11 and back side wall 12 form the handle 1 of the tool. The side walls 11 and 12 may be ergonomically shaped to provide the user with a comfortable holding grip while operating the tool. The side walls 11 and 12 are separated by a spacer 15, shown in FIG. 4, which join side walls 11 and 12 at the tail end of the tool. The gap formed at the head end of the top face of the tool between the two side walls 11 and 12 accommodates the blade holder lock 10. The top face of the blade holder lock 10 sits flush with the top face of the tool between side walls 11 and 12.

Blade holder lock 10 is urged into its rest position, flush with the top face of the tool, by resilient arm 12*a*. The inner face of back side wall 12 has two concave channels 12*b* and 12*c* united at one end to create a resilient arm 12*a* from the material between the channels. Blade holder lock 10 is pivotally attached by a pin 9 to the side walls 11 and 12 and is urged into its rest or locking position by resilient arm 12*a* formed in back side wall 12. When blade holder lock 10 is pushed upward, the holder lock 10 rotates about a pivot so that the tail end of the holder lock 10 engages the resilient arm 12*a* pushing it downwardly creating tension in the arm 12*a*. When holder lock 10 is released, tension in the arm 12*a* is released causing the arm 12*a* to return to its rest position, thus urging blade holder lock 10 into its rest position, flush with the top face of the tool and locking the blade holder 2 in its locked position.

The locking mechanism of this embodiment has the advantage of few moving parts. Having such few parts makes the tool easy to assemble, inexpensive to manufacture and easy to use.

Figure 7:
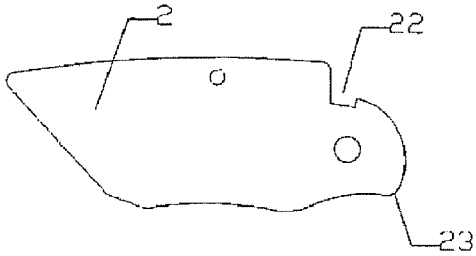
FIG. 7 is a plan view of the front face of the blade holder.

FIG. 7 illustrates a plan view of blade holder 2. Blade holder 2 has a notch 22 adapted to receive the locking tab 10*a* on blade holder lock 10. When the locking tab 10*a* is engaged in notch 22 the blade holder 2 is prevented from rotating, thus holding the blade 3 in position for use. As the blade holder 2 is rotated outward to an extended position for use, locking tab 10*a* remains engaged with a cam 23 formed on the end of blade holder 2. Since, locking tab 10*a* is in constant contact with cam edge 23, the blade holder 2 rotates between open and closed positions smoothly.

Figure 10:
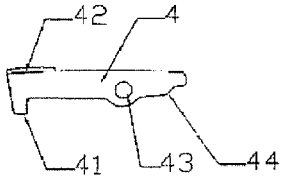
FIG. 10 is a plan view of the blade lock.

To hold the blade 3 in place, blade holder 2 has a blade lock 4. FIG. 10 illustrates a plan view of the blade lock 4. Blade lock 4 is pivotally attached to the blade holder 2 within slot 7 by pin 24 which extends through opening 43. In operation, locking tab 41 of the blade lock 4 is adapted to engage a notch 31 in blade 3 so as to lock the blade 3 in place in blade holder 2. Blade lock 4 also has a blade lock handle 42 fixed to the blade lock 4 and extending from the forward end of the blade lock 4 to aid the user in removing the blade 3. The blade 3 can be removed when a user moves the handle 42 upward which pivots the blade lock 4 about the pin 24 thus providing downward motion of the blade lock 4 at its end 44.

Figure 12:
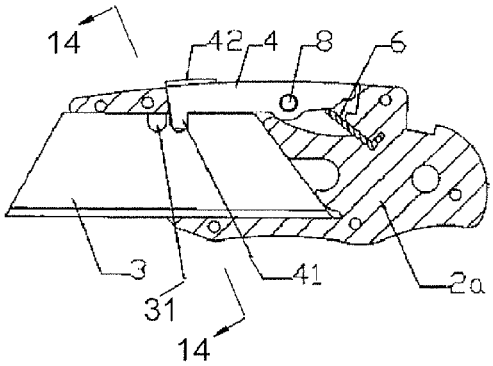
FIG. 12 is a cross-section view of the tool assembly at the first blade slot taken on the line 12-12 of FIG. 14*b*.

The blade holder 2 with blade lock 4 is shown in FIG. 12. When end 44 rotates downwardly, end 44 engages flex assembly 6. As flex assembly 6 moves downward it builds up tension. When the user releases handle 42, the tension is released thereby returning the blade lock 4 to its locking position. Flex assembly 6 functions to maintain blade lock 4 in its locking position.

Figure 8:
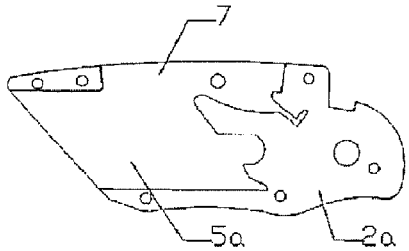
FIG. 8 is a longitudinal cross section view of the blade holder at the first blade slot.
Figure 9:
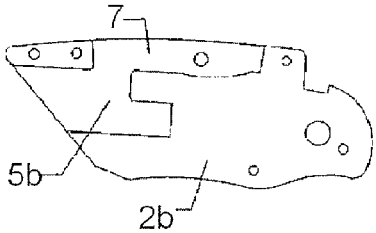
FIG. 9 is a longitudinal cross section view of the blade holder at the second blade slot.
Figure 13:
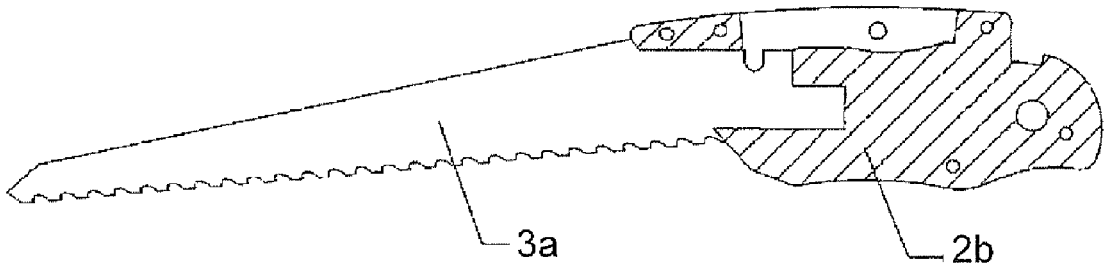
FIG. 13 is a cross-section view of the blade holder at the second blade slot taken on the line 13-13 of FIG. 14*c*.
Figures 14A, 14B, 14C:
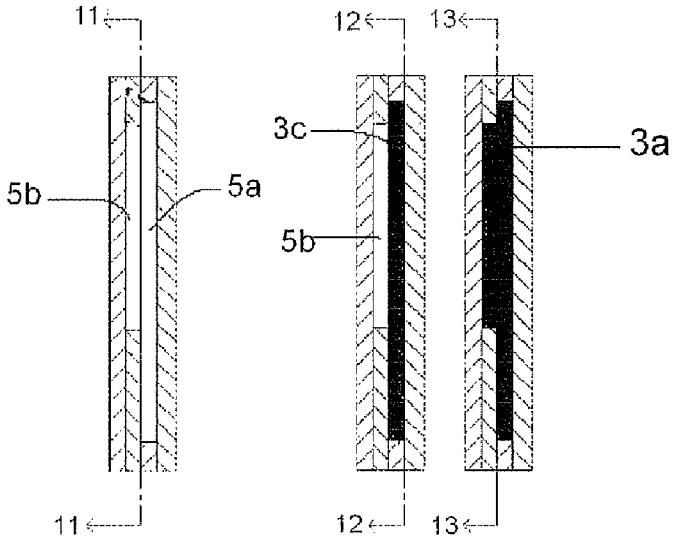
FIG. 14*a* is a cross section view of the blade holder taken on the line 14-14 of FIG. 12 with no blades attached.
FIG. 14*b* is a cross section view of the blade holder taken on the line 14-14 of FIG. 12 with a blade in the first blade slot.
FIG. 14*c* is a cross section view of the blade holder taken on the line 14-14 of FIG. 12 with a blade in the first and second blade slots.
Figure 15A:
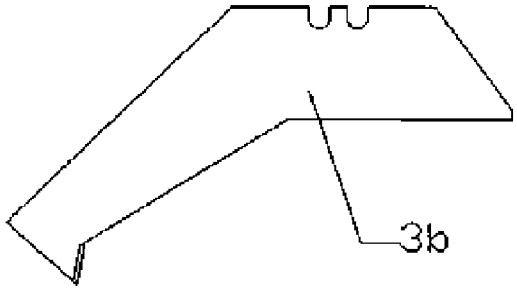
FIG. 15*a* is a plan view showing a blade of a different configuration from the blade of the first embodiment.
Figure 15B:
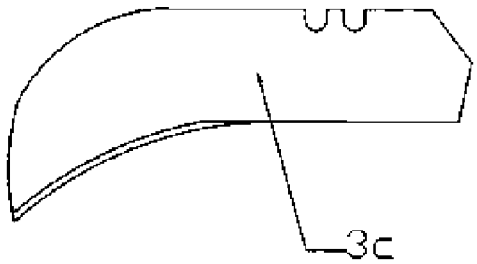
FIG. 15*b* is a plan view showing yet another blade configuration.

Blade 3 in blade holder 4 is removable and exchangeable with other blades or blades of different configurations or thicknesses by operating the blade lock 4. When the blade lock 4 handle 42 is pushed upward, the user can remove a blade 3 and exchange it with a different blade or blade such as blades 3*a*, 3*b*, or 3*c* shown in FIGS. 13, 15*a*, and 15*b* respectively. In order to accommodate blades of different thicknesses, such as the saw blade of FIG. 13, blade holder 2 is formed from layers that provide at least two adjacent blade slots. FIGS. 14*a* through 14*c* illustrate cross-sectional views showing first and second blade slots 5*a* and 5*b* respectively. FIG. 14*a* shows the slots 5*a* and 5*b* with no blade in place. FIG. 8 depicts a cross-sectional view of one layer of the blade holder 2*a* that provides blade slot 5*a* which is adapted to receive a relatively thin blade such as utility knife blade 3. FIG. 14 *b* shows a blade 3*c* in place in slot 5*a*. FIG. 9 illustrates a cross-sectional view of a second layer 2*b* of blade holder 2 that provides blade slot 5*b*. The combined width of blade slots 5*a* and 5*b* are adapted to receive a thicker blade such as saw blade 3*a* illustrated in FIG. 13. FIG. 14*c* is a cross section showing blade 3*e* in place in slots 5*a* and 5*b*. These two adjacent slots 5*a* and 5*b* also provide the slot 7 which is adapted to receive blade lock 4, as previously described.

The length of the slots also varies. The two blade slots 5*a* and 5*b* are of different heights measured across the front face of blade holder 2. In one embodiment, slot 5*a* is adapted to receive a utility blade 3, where as the combined width of blade slots 5*a* and 5*b* is adapted to receive thicker blades, for example a saw blade 3*a*, shown in FIG. 13. Slot 5*b* converges into slot 5*a* at an angle. The smooth transition from slot to slot allows for a blade 3 to transition into the proper slot smoothly. For example, when a user places blade 3 into the tool, the insertion point may be in slot 5*b*, but as the blade 3 is pushed inward, the smooth angled transition urges the blade 3 into the correct slot 5*a*.

Having thus described the invention in connection with the preferred embodiments thereof, it will be evident to those skilled in the art that various revisions can be made to the preferred embodiments described herein with out departing from the spirit and scope of the invention. It is my intention, however, that all such revisions and modifications that are evident to those skilled in the art will be included with in the scope of the following claims.

What is claimed is:

1. A foldable hand tool comprising:

a handle having front and back side walls with opposed inner faces separated by a spacer, wherein a cavity is formed and extends between said side walls; and a blade holder mounted with said handle for axial movement from unfolded to folded position between said opposed inner faces, wherein said blade holder has a front face with an opening having adjacent first and second blade slots, said first slot extends across said front face a length greater than said second slot extends across said front face, and wherein the first slot is adapted to receive a first blade, and the combination of the first and the second slot is adapted to receive a second blade that has a configuration different from that of the first blade.

2. The foldable hand tool of claim 1, wherein said second slot converges into said first slot at an angle for guiding the second blade into said second slot.

3. A foldable hand tool comprising:

a handle having front and back side walls with opposed inner faces separated by a spacer, wherein a cavity is formed and extends between said side walls; and a blade holder pivotally mounted on said handle at a pivot end for axial movement from unfolded to folded position between said opposed inner faces, wherein said blade holder has a front face having first and second blade slots extending therein, wherein said first slot extends across said front face a length greater than said second slot extends across said front face, and wherein said second slot converges into said first slot at an angle so that a blade is guided into said second slot.

4. A foldable hand tool comprising:

a handle having two sides spaced apart forming a cavity therebetween; and a blade holder positioned between the two sides for movement between an inactive position in the cavity and an active position extended from the handle, the blade holder has a front face with an opening extending therein and having adjacent first and second blade slots, the first slot extends along said front face a length greater than said second slot extends along the front face, and wherein the first slot is adapted to receive a first blade, and the combination of the first and the second slot is adapted to receive a second blade that has a configuration different from that of the first blade.

5. The foldable hand tool of claim 4, wherein the inactive position is a folded position and the active position is an unfolded position and the blade holder is mounted for axial movement between the unfolded and folded positions.

6. The foldable hand tool of claim 4, wherein the second slot converges into the first slot at an angle for guiding the second blade into the second slot.

7. The foldable hand tool of claim 6, wherein the two sides of the handle have opposed inner faces that are separated by a spacer and the cavity is formed between the two sides.

8. The foldable hand tool of claim 7, wherein the inactive position is a folded position and the active position is an unfolded position and the blade holder is mounted for axial movement between the unfolded and folded positions.

* * * * *